US006588227B2

(12) United States Patent
Kim et al.

(10) Patent No.: US 6,588,227 B2
(45) Date of Patent: Jul. 8, 2003

(54) ICE MAKER FOR REFRIGERATOR

(75) Inventors: Il-Sin Kim, Changwon (KR); Si-Yeon An, Changwon (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/191,410

(22) Filed: Jul. 10, 2002

(65) Prior Publication Data

US 2003/0010053 A1 Jan. 16, 2003

(30) Foreign Application Priority Data

Jul. 16, 2001 (KR) ..... 2001-42855
Jul. 16, 2001 (KR) ..... 2001-42859
Sep. 24, 2001 (KR) ..... 2001-59125

(51) Int. Cl.[7] ..... F25C 5/18
(52) U.S. Cl. ..... 62/344; 62/353
(58) Field of Search ..... 62/66, 344, 353

(56) References Cited

U.S. PATENT DOCUMENTS 4,697,432 A * 10/1987 Cole ..... 62/233
5,329,786 A * 7/1994 Willis et al. ..... 62/353
5,768,899 A * 6/1998 Lee et al. ..... 62/137
5,889,243 A * 3/1999 Edwards et al. ..... 200/35 R
6,112,540 A * 9/2000 Serrels et al. ..... 62/351
6,216,471 B1 * 4/2001 Patrick et al. ..... 62/71
6,276,160 B1 * 8/2001 Terada et al. ..... 62/353
6,351,955 B1 * 3/2002 Oltman et al. ..... 62/71

FOREIGN PATENT DOCUMENTS

JP 401203689 A * 8/1989 ..... 62/66
JP 4011203868 A * 8/1989 ..... 62/66
JP 408094226 A * 4/1996 ..... F25C/1/24

* cited by examiner

*Primary Examiner*—William E. Tapolcal
*Assistant Examiner*—Mohammad M. Ali
(74) *Attorney, Agent, or Firm*—Fleshner & Kim, LLP

(57) ABSTRACT

The present invention relates to an ice maker for making ice which is installed within a refrigerator. In the ice maker 30 of the present invention, one end of an ice-making container 34 is supported by a frame 32, while the other end thereof is supported by a case 51 of a drive unit 50. The ice-making container 34 is made of metal, and a ground terminal 80 is electrically connected with the ice-making container 34 by a screw 75 for fastening the ice-making container 34 to the case 51, thereby establishing grounding therebeween. The ice maker is provided with a front face plate 42 for connecting the frame 32 and the drive unit 50 in the longitudinal direction along one side of the ice-making container 34. The front face plate 42 is formed with cold air passing-holes for guiding cold air within a freezing chamber of the refrigerator to the ice-making container 34. The cold air passing-holes 45 are provided with louvers 47 for more smoothly guiding the cold air to the air passing-holes, respectively. The drive unit 50 includes a drive lever 56 for driving an ice-sensing lever 60 therein, and a cam follower 57 of the drive lever 56 and a cam 55 of a rotary member 54 are interlocked with each other. The cam 55 is constructed such that a downstream portion 55*d* thereof is declined toward an outer periphery of the rotary member 54, and is continuously and smoothly connected with the outer periphery.

7 Claims, 5 Drawing Sheets

ICE MAKER FOR REFRIGERATOR

BACKGROUND OF THE INVENTION

1. Field of the Invention

The present invention relates to a refrigerator, and more particularly, to an ice maker for a refrigerator capable of making ice by using cold air within the refrigerator.

2. Description of the Prior Art

Referring to FIG. 6, there is shown a perspective view of the constitution of a conventional ice maker. As shown in the figure, a frame 2 is provided at one end of the ice maker 1. An ice-making container 4 is provided between the frame 2 and a drive unit 15 to be explained later. The ice-making container 4 is formed to extend lengthily in one direction. The ice-making container 4 is made of a metal having good thermal conductivity such as aluminum. Mounting brackets 5, 5' are formed integrally with one side of the ice-making container 4 so that the ice maker 1 can be mounted onto a wall of a freezing chamber of the refrigerator. The ice-making container 4 has a cross section in the form of a half moon and is supplied with water through a water supply portion 7 provided at one side of the ice-making container 4.

The ice-making container 4 is provided with an ice-releasing lever 9 for releasing ice, which has been completely made therein, from the ice-making container. The ice-releasing lever 9 has one end connected with the drive unit 15 to be rotated by a driving force transmitted from the drive unit 15 and the other end supported by the frame 2. The ice-releasing lever 9 is formed with a plurality of ice-releasing arms 10 spaced apart at a predetermined interval from one another.

The frame 2 is provided with a front face plate 11 extending along the other side of the ice-making container 4 up to the drive unit 15. The front face plate 11 is formed with a plurality of strippers 12 at a predetermined interval to extend to above the ice-making container 4. The strippers 12 serve to prevent the ice released from the ice-making container 4 from being transferred back to the ice-making container 4.

The drive unit 15 for performing drive of the ice maker 1 is provided at the other end of the ice maker 1. A case 16 defines an outer appearance of the drive unit 15. A support plate 17 shown in FIG. 7 is installed within the case 16. The support plate 17 is provided with components for driving the ice maker 1.

First, a drive motor 18 for providing the driving force for use in driving the ice-releasing lever 9 and the like is installed in the support plate 17. The support plate 17 is provided with a rotary member 19 that can be rotated by receiving the driving force from the drive motor 18 through a plurality of gears (disposed at a rear face of the support plate 17). The rotary member 19 is connected to the one end of the ice-releasing lever 9 and drives the ice-releasing lever 9. A cam 20 is formed on a predetermined section of an outer periphery of the rotary member 19. The cam 20 is constructed such that an upstream portion 20*u* thereof protrudes from the outer periphery of the rotary member 19 and a downstream portion 20*d* thereof also protrudes from the outer periphery of the rotary member 19.

A drive lever 22 is installed in the support plate 17 so as to be driven in a state where it is interlocked with the rotary member 19. The drive lever 22 can rotate over a predetermined angle about a support shaft 24 and is provided at one side thereof with a cam follower 23 interlocked with the cam 20. Reference numeral 23*a* designates a trailing end of the cam follower.

Meanwhile, the support shaft 24 is provided with an ice-sensing lever 26 with one end thereof coaxial with the support shaft 24. The ice-sensing lever 26 is bent several times, and disposed in front of the front face plate 11 as shown in FIG. 6. The other end of the ice-sensing lever is supported by the frame 2.

The conventional ice maker having the aforementioned constitution has the following problems:

First, the ice maker 1 is used in a state of installation within the freezing chamber of the refrigerator, and ice is made in the ice-making container 4. However, since the front face plate 11 extending lengthily along the other side of the ice-making container 4 prevents cold air from being supplied to the ice-making container 4, there is a problem in that the ice is not rapidly formed.

In addition, in the conventional ice maker, the cam 20 of the rotary member 19 is interlocked with the cam follower 23 of the drive lever 22 in order to drive the ice-sensing lever 26. However, the moment the trailing end 23*a* of the cam follower 23 passes by the downstream portion 20*d* of the cam 20, the cam follower 23 suddenly comes into contact with the outer periphery of the rotary member 19. Due to this, since the ice-sensing lever 26 drops by the height of the downstream portion 20*d*, the ice-sensing lever 26 is bumped against the front of the ice maker, thereby generating a crash sound. This crash sound is generated when the ice-sensing lever 26 is moved up to the relatively highest position and then instantaneously drops.

Next, grounding should be made for the safety of electrical components provided for the drive unit 15. In the conventional ice maker, the ice-making container 4 made of metal has been grounded. However, since the ice-making container 4 has a coating on the surface thereof, the coating should be removed from a portion of the surface and a ground terminal should be then fixed to the portion from which the coating has been removed by fastening a separate screw into a hole formed in the portion, for the purpose of the grounding.

SUMMARY OF THE INVENTION

Therefore, the present invention is contemplated to solve the above problems in the prior art. An object of the present invention is to increase the volume of cold air supplied to an ice-making container in which ice is made.

Another object of the present invention is to minimize an operating noise of an ice maker.

A further object of the present invention is to more easily perform grounding of an ice maker.

According to one aspect of the present invention for accomplishing the objects, there is provided an ice maker for a refrigerator, comprising: a frame; an ice-making container with one side thereof supported by the frame in which ice is formed by cold air within a freezing chamber of the refrigerator; an ice-releasing lever for separating the formed ice from the ice-making container and then transferring it to a storage container; a drive unit for providing power for driving of the ice-releasing lever and supporting the other side of the ice-making container; a front face plate extending lengthily in the longitudinal direction of the ice-making container so as to connect between the frame and the drive unit; and cold air passing-holes formed at a predetermined interval in the front face plate for transferring the cold air from the exterior of the front face plate into the interior of the ice-making container.

The cold air passing-holes may be provided with louvers that are open in a direction opposite to a flow direction of the cold air flowing along the front face plate, respectively.

The ice maker may further comprise an ice-sensing lever driven by the drive unit for sensing the amount of ice contained within the storage container.

The drive unit preferably comprises a case for defining an outer appearance of the drive unit, a support plate installed within the case, a drive motor installed in the support plate, a rotary member capable of being rotated by receiving the driving force from the drive motor and driving the ice-releasing lever, and a drive member for driving the ice-sensing lever while being rotated by receiving the driving force from the drive motor through a cam of the rotary member.

The cam of the rotary member may be constructed such that a downstream portion thereof is declined toward an outer periphery of the rotary member to be continuously and smoothly connected with the outer periphery of the rotary member can.

One end of the ice-making container may be fastened to the case by a screw that is fastened within the case of the drive unit, and a ground terminal for grounding electrical components of the drive unit is connected to the screw.

The case is preferably formed with a fastening hole through which the screw penetrates, and a rib having an inner diameter adapted to receive the screw and the ground terminal protrudes from an edge of the fastening hole.

BRIEF DESCRIPTION OF THE DRAWINGS

The above and other objects and features of the present invention will become apparent from the following description of a preferred embodiment given in conjunction with the accompanying drawings, in which.

DETAILED DESCRIPTION OF THE INVENTION

Hereinafter, an ice maker for a refrigerator according to a preferred embodiment of the present invention will be described in detail with reference to the accompanying drawings.

Figure 1:
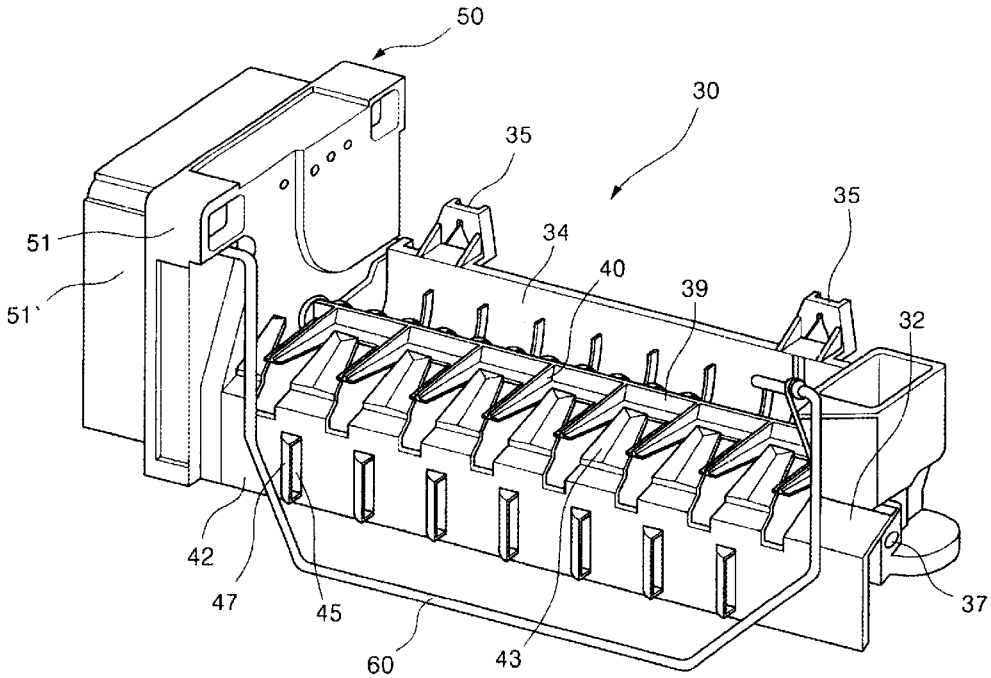
FIG. 1 is a perspective view showing an outer appearance of an ice maker for a refrigerator according to a preferred embodiment of the present invention.
Figure 2:
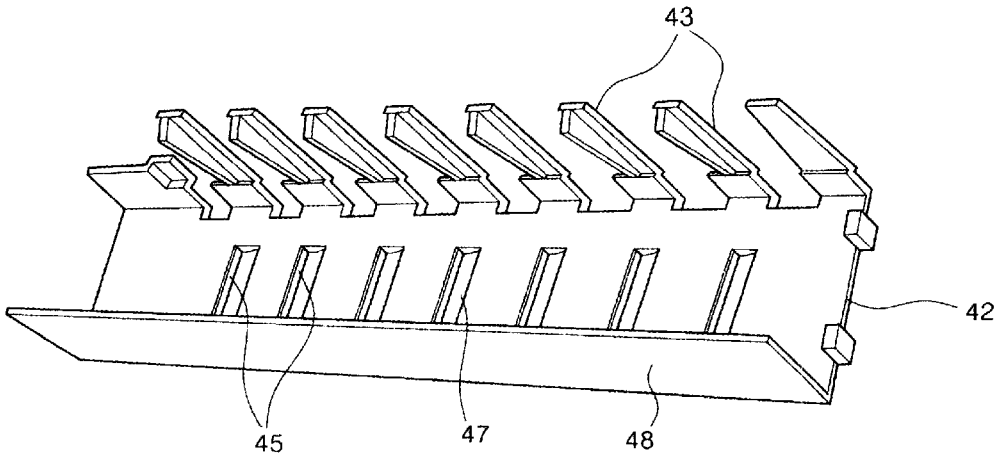
FIG. 2 is a perspective view showing the constitution of a front face plate and its vicinities constituting the embodiment of the present invention.
Figure 3:
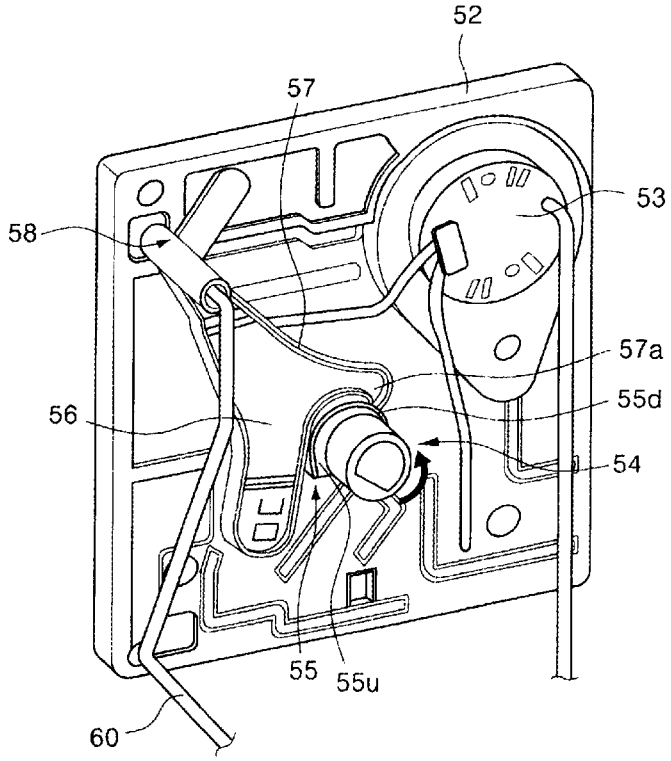
FIG. 3 is a perspective view showing the constitution of a support plate constituting the embodiment of the present invention.
Figure 4:
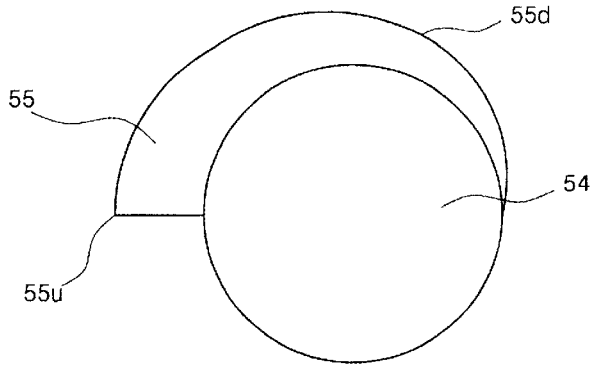
FIG. 4 is a perspective view showing the configuration of a rotary member constituting the embodiment of the present invention.
Figure 5:
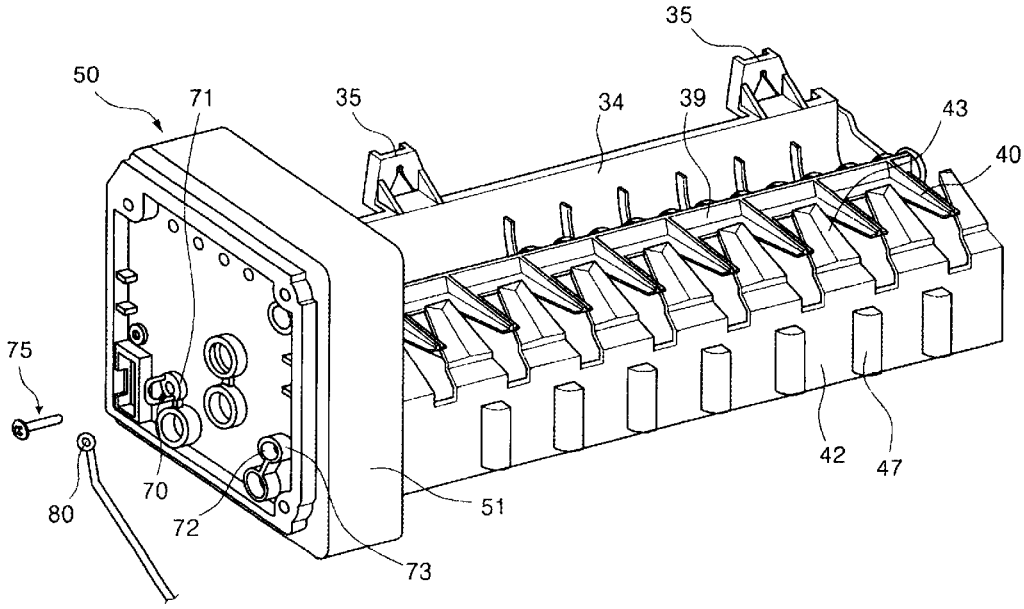
FIG. 5 is a perspective view showing the inner constitution of a case constituting the embodiment of the present invention.
Figure 6:
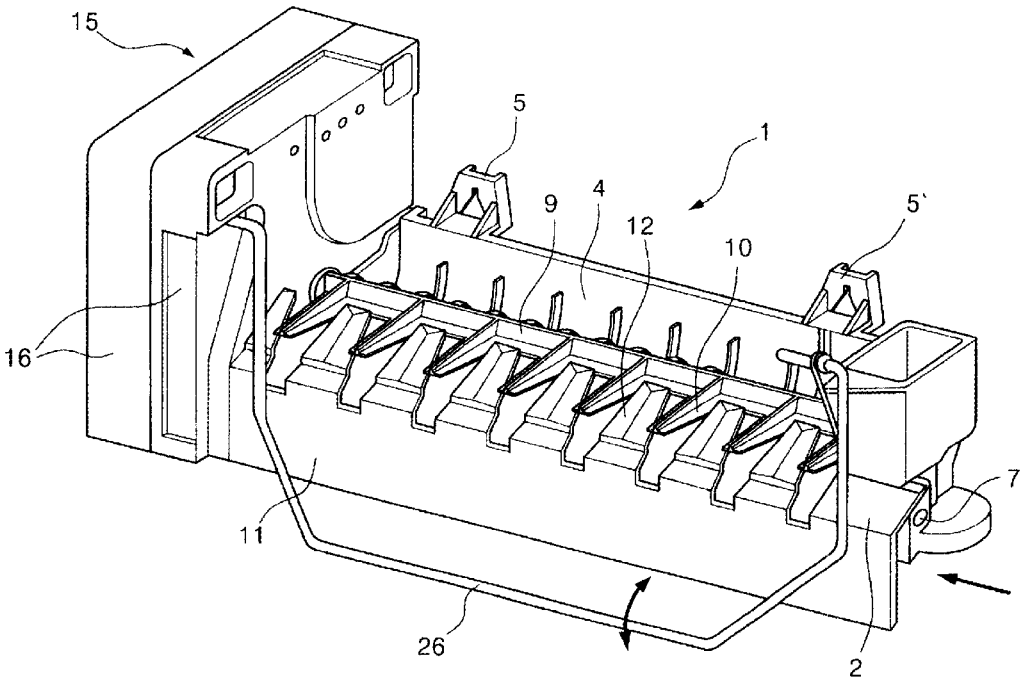
FIG. 6 is a perspective view showing the outer constitution of a conventional ice maker for a refrigerator.
Figure 7:
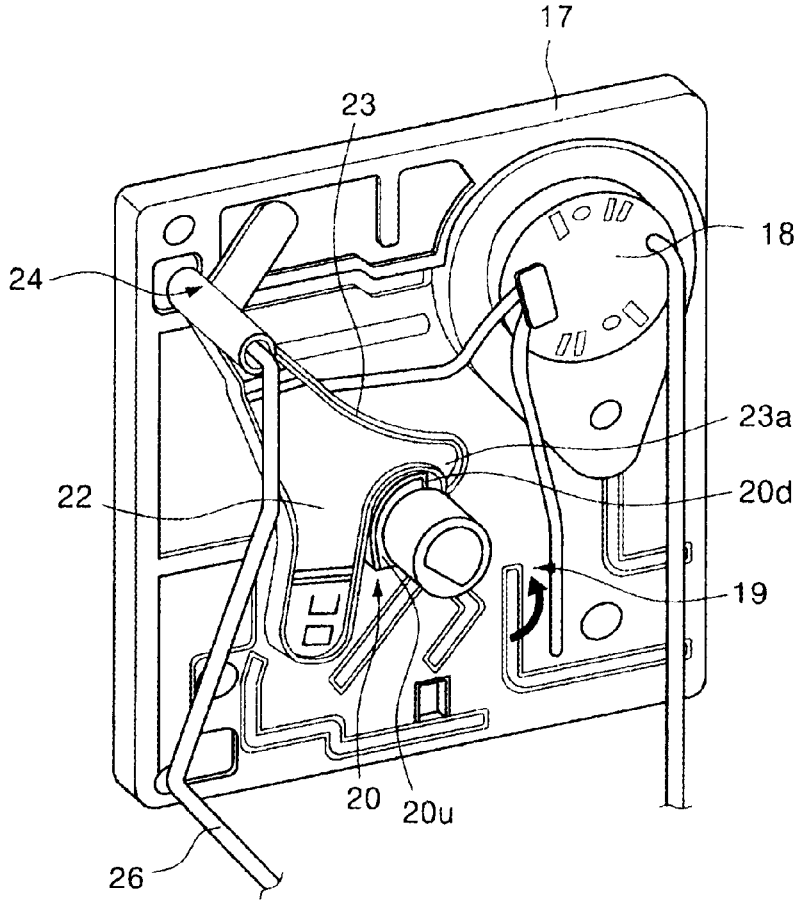
FIG. 7 is a perspective view showing the constitution of a support plate of the conventional ice maker.

FIG. 1 is a perspective view showing an outer appearance of the ice maker for the refrigerator according to the preferred embodiment of the present invention; FIG. 2 is a perspective view showing the constitution of a front face plate and its vicinities constituting the embodiment of the present invention; FIG. 3 is a perspective view showing the constitution of a support plate constituting the embodiment of the present invention; FIG. 4 is a plan view showing the configuration of a rotary member constituting the embodiment of the present invention; and FIG. 5 is a perspective view showing the inner constitution of a case constituting the embodiment of the present invention.

As shown in the figures, a frame 32 is provided at one end of an ice maker 30 according to the embodiment of the present invention. An ice-making container 34 is provided between the frame 32 and a drive unit 50 to be explained later. The ice-making container 34 is constructed such that one end thereof is fixed to the drive unit 50 and the other end thereof is connected with the frame 32. The ice-making container 34 has an inner structure in which a large quantity of ice can be made to have a predetermined shape and of which cross section is in the form of a half moon. The ice-making container 34 is formed of a metal having good thermal conductivity such as aluminum.

Mounting brackets 35 are formed at one side of the ice-making container 34. The mounting brackets 35 allow the ice maker 30 to be mounted onto a wall of a freezing chamber of the refrigerator. A water supply portion 37 is provided at one end of the ice-making container 34. Water is supplied through the water supply portion 37 from the exterior to the ice-making container 34.

An ice-releasing lever 39 is provided at above the ice-making container 34. The ice-releasing lever 39 serves to transfer the ice that has been completely made in the ice-making container 34 to a storage container (not shown), and is constructed such that one end thereof is connected to the drive unit 50 to receive power for rotation and the other end thereof is supported by the frame 32. The ice-releasing lever 39 is formed with a plurality of ice-releasing arms 40 spaced apart at a predetermined interval from one another in a direction perpendicular to the longitudinal direction of the ice-releasing lever 39.

In the meantime, a front face plate 42 is installed along the other side of the ice-making container 34. That is, the front face plate 42 is installed between the frame 32 and the drive unit 50. It is considered that the front face plate 42 constitutes a portion of the frame 32. The front face plate 42 is formed with a plurality of strippers 43 to extend to above the ice-making container 34. The strippers 43 serve to prevent the ice released from the ice-making container 34 from being transferred back to the ice-making container 34. The ice-releasing arms 40 pass through between the strippers 43 when the ice-releasing lever 39 is rotated.

The front face plate 42 is also formed with a number of cold air passing-holes 45 for transferring cold air to the ice-making container 34. The cold air passing-holes 45 are provided on edges thereof with louvers 47 for guiding the cold air to the cold air passing-holes 45, respectively. The louvers 47 is preferably constructed such that the openings thereof are formed in a direction opposite to the flow direction of the cold air along the front face plate 42. Reference numeral 48 designates a bottom plate formed to extend integrally with the front face plate 42.

An outer appearance of the drive unit 50 is defined by cases 51, 51'. The cases 51, 51' accommodate components for driving the ice-releasing lever 39. A support plate 52 shown in FIG. 3 is provided in the cases 51, 51'. A drive motor 53 is installed at one side of the support plate 52. The driving force from the drive motor 53 is transmitted through a plurality of gears (not shown) disposed at a rear face of the support plate 52.

The support plate 52 is provided with a rotary member 54 for driving the ice-releasing lever 39. The rotary member 54 is connected to the one end of the ice-releasing lever 39. A cam 55 is formed on an outer periphery of the rotary member 54. The cam 55 is formed to take the shape well shown in FIG. 4. That is, the cam 55 is constructed such that an upstream portion 55*u* thereof is formed to steeply rise from the outer periphery of the rotary member 54. The cam 55 is also constructed such that a downstream portion 55*d* thereof is formed to be declined gradually toward the outer periphery of the rotary member 54 to be continuously and smoothly connected with the outer periphery of the rotary member 54. A section between the upstream portion 55*u* and the downstream portion 55*d* of the cam 55 has a shape required for driving of a drive lever 56 to be explained later.

The drive lever 56 is installed in the support plate 52 so that it can rotate over a predetermined angle about a support shaft 58. The drive lever 56 is formed with a cam follower 57 interlocked with the cam 55 of the rotary member 54. The cam follower 57 is guided along the cam 55 and rotates the drive lever 56 over the predetermined angle. Reference numeral 57*a* designates a trailing end of the cam follower 57.

An ice-sensing lever 60 is installed in front of the front face plate 42 of the ice maker 30. The ice-sensing lever 60 is constructed such that one end thereof is fitted into the support shaft 58 to be rotated in response to the rotation of the drive lever 56, as well shown in FIG. 3. The other end of the ice-sensing lever 60 is supported by one side of the frame 32. This ice-sensing lever 60 serves to sense the amount of ice stored in the storage container provided below the ice maker 30.

Next, the constitution for grounding of the ice maker according to this embodiment of the present invention will be described with reference to FIG. 5.

Fastening holes 70, 72 are perforated in an inside surface of the case 51 adjacent the ice-making container 34. The fastening holes 70, 72 are portions through which screws 75 pass to fasten the case 51 to the ice-making container 34. These fastening holes 70, 72 are formed when the case 51 is injection molded. Ribs 71, 73 are formed around edges of the fastening holes 70, 72. The ribs 71, 73 have inner diameters and heights enough to completely receive the screws 75 fastened into the fastening holes 70, 72, respectively.

Here, a ground terminal 80 is fastened by the screw 75 fastened into one of the fastening holes 70, 72. The ground terminal 80 is a ring-shaped portion formed at one end of a ground wire, and fastened into one of the fastening holes 70, 72 by the fastening of the screw 75. The screw 75 is made of metal and performs grounding between the ground terminal 80 and the ice-making container 34 of metal by electrically connecting them to each other.

The operation of the ice maker for the refrigerator according to the present invention constructed as such will be described in detail below.

In the ice maker 30 of this embodiment, the water is supplied to the ice-making container 34 through the water supply portion 37. The water supplied to the ice-making container 34 is frozen by the cold air flowing as indicated by a thick arrow in FIG. 1. First, the cold air transferred to a rear face of the front face plate 42 forms the water into ice by heat exchange with the surface of the ice-making container 34.

Here, after the cold air flowing along a front face of the front face plate 42 is guided into the cold air passing-holes 45 by means of the respective louvers 47, it is supplied to the ice-making container 34 through the cold air passing-holes 45 and then heat exchanged with the ice-making container 34. Accordingly, since a large amount of cold air is supplied to the ice-making container 34, ice is rapidly formed.

When the ice is formed in the ice-making container 34, a heater (not shown) radiates heat so that the ice is slightly separated from the ice-making container 34. Then, while the rotary member 54 is rotated by the driving force from the drive motor 53, the ice-releasing lever 39 is driven. Since the ice-releasing lever 39 is rotated by the rotary member 54 rotating in the counterclockwise direction as indicated by an arrow in FIG. 3, the ice is separated from the ice-making container 34 and then transferred to the storage container.

In the meantime, the ice-sensing lever 60 senses the amount of ice contained within the storage container while rotating by an interlocking operation between the rotary member 54 and the drive lever 56. When the ice-sensing lever 60 senses that the amount of ice contained within the storage container is larger than a predetermined amount, the ice-releasing lever 39 is caused not to operate.

At this time, the interlocking operation between the rotary member 54 and the drive lever 56 is established by the cam 55 and the cam follower 57. The trailing end 57*a* of the cam follower 57 and the upstream portion 55*u* of the cam 55 first come into contact with each other, and the cam follower 57 is then guided to the downstream portion 55*d* from the upstream portion 55*u* along the cam 55.

Since the downstream portion of the cam 55 is formed to be declined toward the outer periphery of the rotary member 54, the position of the drive lever 56 does not suddenly change at the end of contact between the cam 55 and the cam follower 57. This means that sudden rotation of the ice-sensing lever 60 which is rotated by the drive lever 56 is not produced.

Next, in the ice maker of this embodiment, the grounding of the electrical components contained within the drive unit 50 is performed by connecting the ice-making container 34 of metal and the ground terminal 80. That is, the ground terminal 80 is positioned at one of the fastening holes 70, 72 formed in the case 51, and the metal screw 75 then passes through one of the fastening holes 70, 72, thereby fastening the case to the ice-making container 34. Accordingly, since the ground terminal 80 and the ice-making container 34 are electrically connected to each other by the screw 75, the grounding therebetween is established.

In the ice maker for the refrigerator according to the present invention as described in detail above, since the volume of cold air transferred to the ice-making container of the ice maker is relatively large, it takes less time to make ice, thereby efficiently making the ice. Especially, by virtue of the louvers provided at the cold air passing-holes of the front face plate, a larger volume of cold air can be transferred to the ice-making container.

Next, in the ice maker of the present invention, since the cam of the rotary member coming into contact with the cam follower of the drive lever for driving the ice-sensing lever is constructed such that the downstream portion of the cam is formed to be declined toward the outer periphery of the rotary member, the interlocking operation between the drive lever and the rotary member is not rapidly terminated. Accordingly, since the ice-sensing lever is prevented from suddenly dropping at the end of an ice-sensing operation of the ice-sensing lever, thereby avoiding any generation of crash sounds.

Finally, in the ice maker of the present invention, in order to ground the electrical components used in the ice-maker, the ground terminal is fastened to the case by the screw that fastens the case to the ice-making container, thereby establishing the grounding between the ground terminal and the ice-making container. Accordingly, the grounding can be performed with a simpler structure without providing the outside of the ice maker with any additional ground structures for contact with the ground terminal.

Although the present invention has been described with respect to the preferred embodiment, the embodiment is intended not to limit but to exemplify the present invention. It will be understood by those skilled in the art that various changes, alterations and modifications may be made to the present invention without departing from the spirit and scope of the invention. Therefore, the scope of the present invention should be construed as being limited only by the appended claims, and as covering all the changes, alterations and modifications.

What is claimed is:

1. An ice maker for a refrigerator, comprising:

a frame;

an ice-making container with one side thereof supported by the frame in which ice is formed by cold air within a freezing chamber of the refrigerator;

an ice-releasing lever for separating the formed ice from the ice-making container and then transferring it to a storage container;

a drive unit for providing power for driving of the ice-releasing lever and supporting the other side of the ice-making container;

a front face plate extending lengthily in the longitudinal direction of the ice-making container so as to connect between the frame and the drive unit; and cold air passing-holes formed at a predetermined interval in the front face plate for transferring the cold air from the exterior of the front face plate into the interior of the ice-making container.

2. The ice maker as claimed in claim 1, wherein the cold air passing-holes are provided with louvers that are open in a direction opposite to a flow direction of the cold air flowing along the front face plate, respectively.

3. The ice maker as claimed in claim 1, further comprising an ice-sensing lever driven by the drive unit for sensing the amount of ice contained within the storage container.

4. The ice maker as claimed in claim 3, wherein the drive unit comprises a case for defining an outer appearance of the drive unit, a support plate installed within the case, a drive motor installed in the support plate, a rotary member capable of being rotated by receiving the driving force from the drive motor and driving the ice-releasing lever, and a drive member for driving the ice-sensing lever while being rotated by receiving the driving force from the drive motor through a cam of the rotary member.

5. The ice maker as claimed in claim 4, wherein the cam of the rotary member is constructed such that a downstream portion thereof is declined toward an outer periphery of the rotary member to be continuously and smoothly connected with the outer periphery of the rotary member.

6. The ice maker as claimed in claim 1, wherein one end of the ice-making container is fastened to the case by a screw that is fastened within the case of the drive unit, and a ground terminal for grounding electrical components of the drive unit is connected to the screw.

7. The ice maker as claimed in claim 6, wherein the case is formed with a fastening hole through which the screw penetrates, and a rib having an inner diameter adapted to receive the screw and the ground terminal protrudes from an edge of the fastening hole.

* * * * *